US008043123B2

(12) United States Patent
Hsieh

(10) Patent No.: US 8,043,123 B2
(45) Date of Patent: Oct. 25, 2011

(54) POWER RECEPTACLE FOR PORTABLE ELECTRONIC DEVICE

(75) Inventor: Sheng-Ming Hsieh, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 12/876,243

(22) Filed: Sep. 7, 2010

(65) Prior Publication Data

US 2011/0092106 A1 Apr. 21, 2011

Related U.S. Application Data

(60) Provisional application No. 61/251,746, filed on Oct. 15, 2009, provisional application No. 61/262,560, filed on Nov. 19, 2009.

(51) Int. Cl.
*H01R 24/04* (2006.01)

(52) U.S. Cl. ..... 439/669; 439/924.1; 439/637

(58) Field of Classification Search ..... 439/660, 439/626, 289, 290, 669, 825, 668, 924.1, 439/637, 857, 858

See application file for complete search history.

(56) References Cited

U.S. PATENT DOCUMENTS 4,734,041 A * 3/1988 Bruchmann et al. ..... 439/637

* cited by examiner

*Primary Examiner* — Javaid Nasri

(74) *Attorney, Agent, or Firm* — Jianq Chyun IP Office

(57) ABSTRACT

A power receptacle for a portable electronic device suitable for connecting a power plug is provided. The power plug has a tubular terminal and a clamping terminal in the tubular terminal. The power receptacle includes an insulating housing, an anode terminal, and a cathode terminal. The insulating housing has a receiving cavity, and the power plug is suitable for being plug in the receiving cavity. The anode terminal disposed in the insulating housing is located at the central part of the receiving cavity. The cathode terminal disposed in the insulating housing is located at a side of the receiving cavity. During a process of plugging the power plug into the receiving cavity, the tubular terminal contacts the cathode terminal, and then the clamping terminal contacts the anode terminal, so that the power plug is electrically connected to the power receptacle.

6 Claims, 3 Drawing Sheets

POWER RECEPTACLE FOR PORTABLE ELECTRONIC DEVICE

CROSS-REFERENCE TO RELATED APPLICATION

This application claims the priority benefit of U.S.A. provisional application Ser. No. 61/251,746 filed on Oct. 15, 2009, and application Ser. No. 61/262,560 filed on Nov. 19, 2009. The entirety of the above-mentioned patent application is hereby incorporated by reference herein and made a part of specification.

BACKGROUND

1. Field of the Invention

The invention relates to a power receptacle. More particularly, the invention relates to a power receptacle for a portable electronic device.

2. Description of Related Art

A direct current (DC) power receptacle is a most important connection port of a notebook computer, and power supplying and battery charging all rely on the DC power receptacle. Although the power receptacles are continuously developed by various manufactures, there are still problems in security and reliability of the power receptacle.

According to an existing technology, during a process of plugging a power plug into the power receptacle, an anode terminal of the power plug generally contacts an anode terminal of the power receptacle first, and then a cathode terminal of the power plug contacts a cathode terminal of the power receptacle, so as to achieve the electrical connection.

However, during the above process, if the power plug or the power receptacle has a poor structure design or the power plug is only plugged into the power receptacle by a half, i.e. only the anode terminals of the power plug and the power receptacle are connected, a contact impedance of the terminals is increased due to such instable connection state, so that once such abnormal power supplying state lasts for a long time, a structure of the power receptacle or the power plug can be damaged due to overheating, or even the whole device is burnout.

Therefore, it is necessary for those related practitioners to develop a power receptacle without the above problem.

SUMMARY OF THE INVENTION

The invention is directed to a power receptacle for a portable electronic device, which may have a good reliability by maintaining a low contact impedance between terminals of the power receptacle and a power plug.

The invention provides a power receptacle for a portable electronic device, which is suitable for connecting a power plug. The power plug has a tubular terminal and a clamping terminal in the tubular terminal. The power receptacle includes an insulating housing, an anode terminal, and a cathode terminal. The insulating housing has a first receiving cavity, and the power plug is suitable for being plugged in the first receiving cavity. The anode terminal is disposed in the insulating housing and is located at a central part of the first receiving cavity. The cathode terminal is disposed in the insulating housing and is located at a side of the first receiving cavity. During a process of plugging the power plug into the first receiving cavity, the tubular terminal first contacts the cathode terminal, and then the clamping terminal contacts the anode terminal, so that the power plug is electrically connected to the power receptacle.

In an embodiment of the invention, the cathode terminal is a spring having a press-connecting part, and the press-connecting part extends towards the anode terminal from the insulating housing. When the power plug is plugged in the first receiving cavity, the tubular terminal leans against the press-connecting part.

In an embodiment of the invention, the tubular terminal has a second receiving cavity, and the anode terminal is suitable for being plugged in the second receiving cavity.

In an embodiment of the invention, during a process of plugging the tubular terminal into the first receiving cavity, the tubular terminal first contacts the press-connecting part of the cathode terminal, and then the anode terminal is plugged in the second receiving cavity, and is clamped by the clamping terminal.

In an embodiment of the invention, the anode terminal substantially has a column shape, so that the anode terminal is suitable for being clamped by the clamping terminal.

In an embodiment of the invention, the power receptacle further includes a fixed spring disposed in the insulating housing and is located in the first receiving cavity at another side opposite to the cathode terminal, wherein after the power plug is plugged in the first receiving cavity, the fixed spring and the cathode terminal commonly clamp the tubular terminal.

According to the above descriptions, in the power receptacle for the portable electronic device, based on a relative configuration of the anode terminal and the cathode terminal in the insulating housing, during a process of plugging the power plug in the receiving cavity of the insulating housing, the cathode terminal first contacts the tubular terminal, and then the anode terminal contacts the clamping terminal. In this way, a contact impedance between the terminals can be maintained, so as to avoid a risk of high temperature caused by a high impedance due to a prior contact of the anode terminals. Therefore, the power receptacle may have a good reliability and security.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
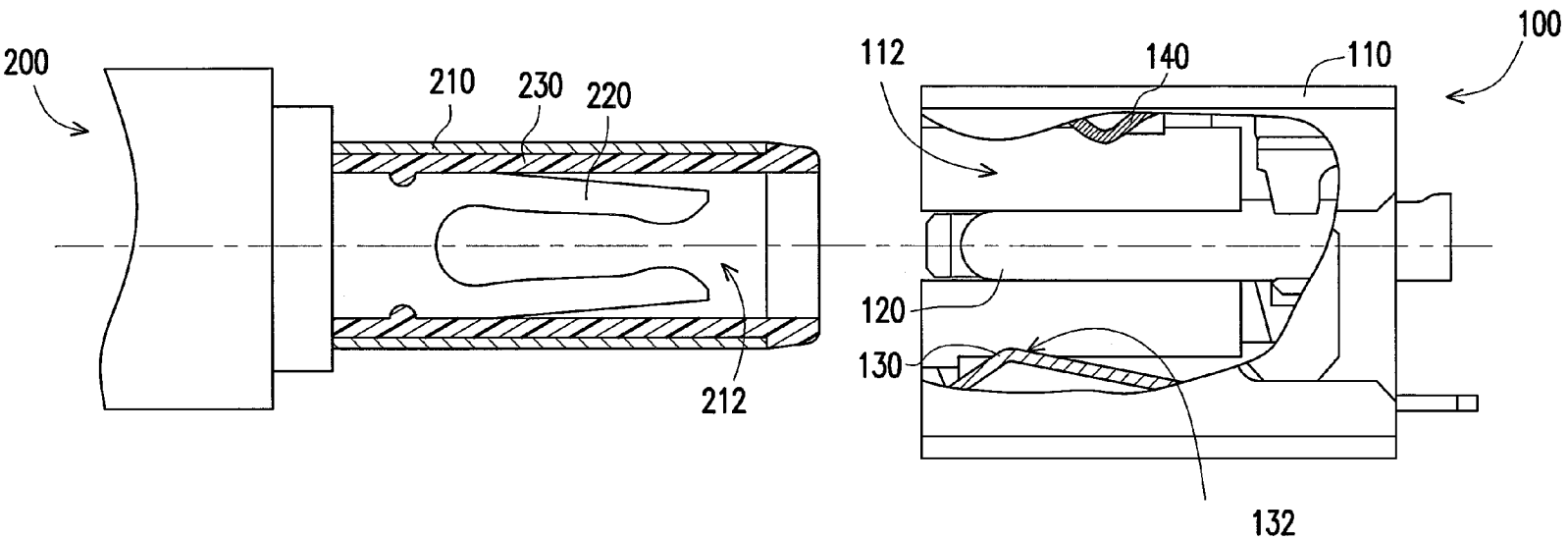
FIGS. 1-3 are diagrams illustrating a process of plugging a conventional power plug in a power receptacle according to an embodiment of the invention.
Figure 2:
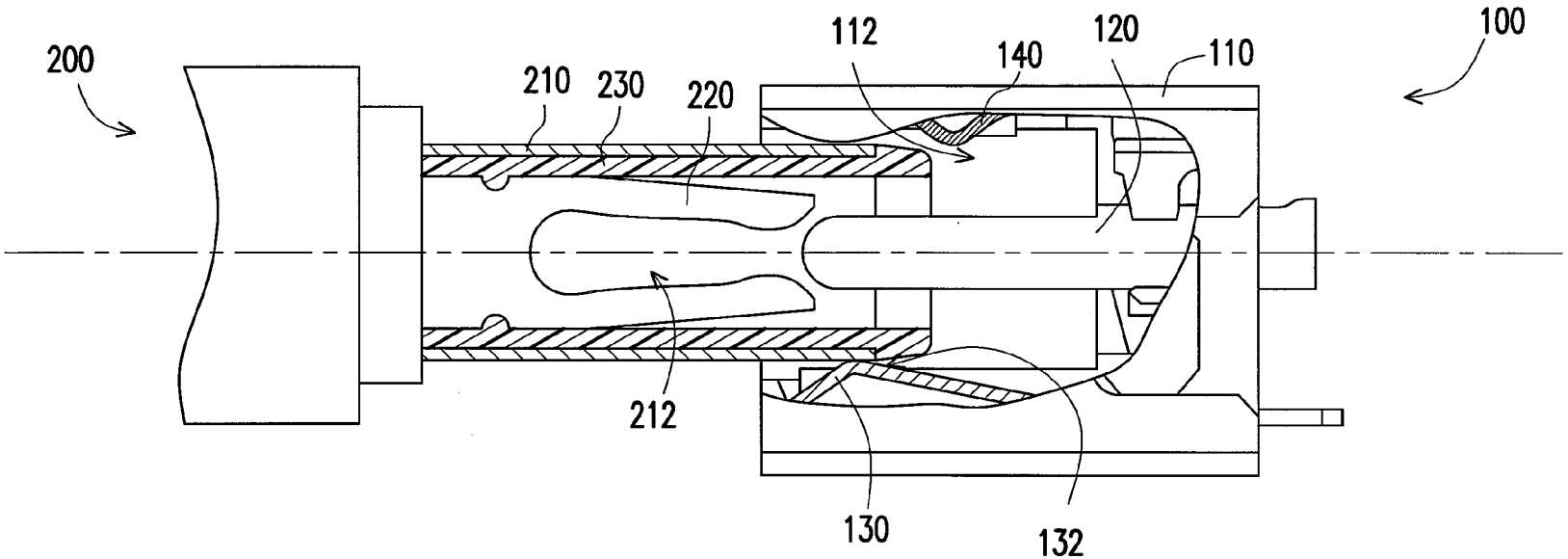
Figure 3:
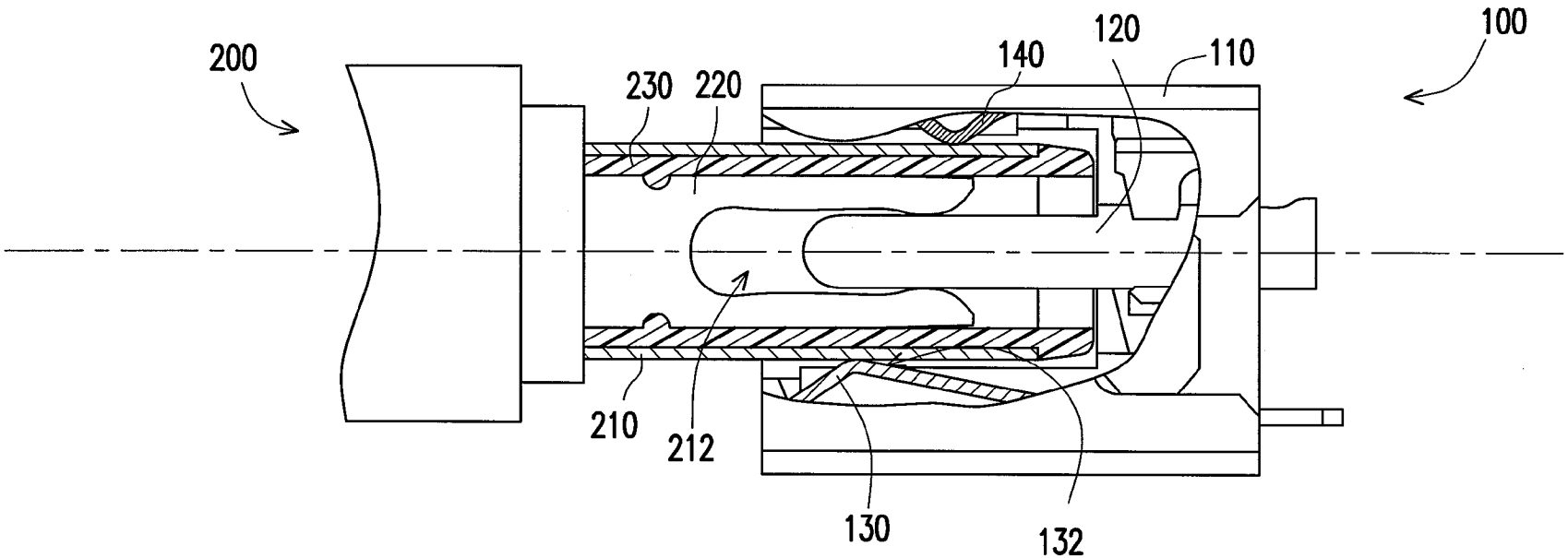

FIGS. 1-3 are diagrams illustrating a process of plugging a conventional power plug in a power receptacle according to an embodiment of the invention. Referring to FIGS. 1-3, in the present embodiment, the power receptacle 100 is adapted to be applied to a portable electronic device (not shown) for connecting a power plug 200. The power plug 200 has a tubular terminal 210, a clamping terminal 220 disposed in the tubular terminal 210 and a tubular insulator 230 disposed between the tubular terminal 210 and the clamping terminal 220 for insulation.

The power receptacle 100 includes an insulating housing 110, an anode terminal 120, and a cathode terminal 130. The insulating housing 110 has a first receiving cavity 112, and the power plug 200 is suitable for being plugged in the first receiving cavity 112. The anode terminal 120 is disposed in the insulating housing 110 and is located at a central part of the first receiving cavity 112. The cathode terminal 130 is disposed in the insulating housing 110 and is located at a side of the first receiving cavity 112.

Conventionally, a distance is substantially maintained between the clamping terminal 220 of the power plug 200 and an opening of the tubular terminal 210, so that during a process of plugging the power plug 200 in the first receiving cavity 112, the tubular terminal 210 first contacts the cathode terminal 130 (as that shown in FIG. 2), and then the clamping terminal 220 contacts the anode terminal 120 (as that shown in FIG. 3), so that the power plug 200 is electrically connected to the power receptacle 100.

Accordingly, during the process of connecting the power plug 200 to the power receptacle 100, based on a relative configuration of the anode terminal 120 and the cathode terminal 130 in the insulating housing 110, the cathode terminal 130 of the power receptacle 100 may first contact the tubular terminal 210 serving as a cathode of the power plug 200, so as to avoid a situation that the anode terminal 120 of the power receptacle 100 first contacts the clamping terminal 220 serving as an anode of the power plug 200, so that a risk of high temperature caused by a high contact impedance between the two anode terminals can be avoided.

Further, in the present embodiment, the cathode terminal 130 is substantially a spring, which has a press-connecting part 132, and the press-connecting part 132 extends towards the anode terminal 120 from the insulating housing 110. When the power plug 200 is plugged in the first receiving cavity 112, the tubular terminal 210 leans against the press-connecting part 132. Moreover, the tubular terminal 210 has a second receiving cavity 212. The clamping terminal 220 is located in the second receiving cavity 212, and the anode terminal 120 of the power receptacle 100 is suitable for being plugged in the second receiving cavity 212. In detail, during the process of plugging the power plug 200 in the power receptacle 100, the tubular terminal 210 first contacts the press-connecting part 132 of the cathode terminal 130, and then the anode terminal 120 is plugged in the second receiving cavity 212. Here, the anode terminal 120 substantially has a column shape, so that it is suitable for being clamped by the clamping terminal 220 in the second receiving cavity 212.

The relative configuration relationship between the anode terminal 120 and the cathode terminal 130 of the power receptacle 100 is not limited by the present embodiment, i.e. configurations of the anode terminal 120 and the cathode terminal 130 of the power receptacle 100 can be changed according to terminal configurations of the power plug 200. Therefore, any structure that ensures a prior contact between the cathode terminals of the power plug 200 and the power receptacle 100 other than a prior contact between the anode terminals thereof is considered to be complied with the spirit of the invention.

On the other hand, the power receptacle 100 further includes a fixed spring 140, which is disposed in the insulating housing 110 and is located in the first receiving cavity 130 at another side opposite to the cathode terminal 130. After the power plug 200 is plugged in the first receiving cavity 112, the fixed spring 140 and the cathode terminal 130 commonly clamp the tubular terminal 210 of the power plug 200, so as to provide a good plugging effect between the power plug 200 and the power receptacle 100.

In summary, in the power receptacle for the portable electronic device, based on a relative configuration of the anode terminal and the cathode terminal in the insulating housing, during a process of plugging the power plug in the receiving cavity of the insulating housing, the cathode terminal first contacts the tubular terminal, and then the anode terminal contacts the clamping terminal. In this way, a contact between the cathode terminals of the power plug and the power receptacle is first implemented compared to a contact between the anode terminals thereof, so that a contact impedance between the terminals can be maintained, so as to avoid a risk of high temperature caused by a high impedance due to a prior contact of the anode terminals. Therefore, the power receptacle may have a good reliability and security.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A power receptacle of a portable electronic device, suitable for connecting a power plug, the power plug having a tubular terminal and a clamping terminal in the tubular terminal, and the power receptacle comprising:

an insulating housing, having a first receiving cavity, wherein the power plug is suitable for being plugged in the first receiving cavity;

an anode terminal, disposed in the insulating housing and located at a central part of the first receiving cavity; and a cathode terminal, disposed in the insulating housing and located at a side of the first receiving cavity, wherein during a process of plugging the power plug into the first receiving cavity, the tubular terminal first contacts the cathode terminal, and then the clamping terminal contacts the anode terminal, so that the power plug is electrically connected to the power receptacle.

2. The power receptacle as claimed in claim 1, wherein the cathode terminal is a spring having a press-connecting part, and the press-connecting part extends towards the anode terminal from the insulating housing, and when the power plug is plugged in the first receiving cavity, the tubular terminal leans against the press-connecting part.

3. The power receptacle as claimed in claim 2, wherein the tubular terminal of the power plug has a second receiving cavity, and the anode terminal is suitable for being plugged in the second receiving cavity.

4. The power receptacle as claimed in claim 3, wherein during a process of plugging the power plug into the first receiving cavity, the tubular terminal first contacts the press-connecting part of the cathode terminal, and then the anode terminal is plugged in the second receiving cavity, and is clamped by the clamping terminal.

5. The power receptacle as claimed in claim 4, wherein the anode terminal substantially has a column shape, so that the anode terminal is suitable for being clamped by the clamping terminal.

6. The power receptacle as claimed in claim 2, further comprising:

a fixed spring, disposed in the insulating housing and located in the first receiving cavity at another side opposite to the cathode terminal, wherein after the power plug is plugged in the first receiving cavity, the fixed spring and the cathode terminal commonly clamp the tubular terminal.

* * * * *